United States Patent [19]

Draper

[11] 4,165,873

[45] Aug. 28, 1979

[54] EXERCISING PARALLEL BAR

[76] Inventor: George C. Draper, 282 Westgate Crecent, Rosemere, Quebec, Canada

[21] Appl. No.: 781,999

[22] Filed: Mar. 28, 1977

Related U.S. Application Data

[63] Continuation-in-part of Ser. No. 687,090, May 17, 1976, abandoned.

[51] Int. Cl.[2] ..... A63B 3/00

[52] U.S. Cl. ..... 272/63; 128/25 R; 272/143

[58] Field of Search ..... 272/62, 63, 112, 113, 272/144, DIG. 4, 109, 67, 68, 70.4, 70.3; 128/25 R; 135/67, 71, 72

[56] References Cited

U.S. PATENT DOCUMENTS

| | | | |
|---|---|---|---|
| 594,572 | 11/1897 | Slavik | 128/94 |
| 1,307,058 | 6/1919 | McGrath | 135/67 |
| 1,734,664 | 11/1929 | Albach | 272/63 |
| 1,837,872 | 12/1931 | Johnson | 128/94 X |
| 2,077,569 | 4/1937 | Kish | 272/70.4 |
| 2,129,260 | 9/1938 | Bowser | 297/6 |
| 2,297,173 | 9/1942 | Shipman et al. | 272/70.4 |
| 2,634,790 | 4/1953 | Elle | 135/67 |
| 2,666,640 | 1/1954 | Jennings | 272/63 |
| 2,788,971 | 4/1957 | Berne | 272/63 |
| 3,046,980 | 7/1962 | Moore et al. | 128/75 |
| 3,046,980 | 7/1962 | Moore et al. | 128/87 R X |
| 3,195,550 | 7/1965 | Ingalls et al. | 135/67 |
| 3,534,955 | 10/1970 | Wieland | 272/63 |
| 3,716,049 | 2/1973 | Kaplan | 128/75 |
| 3,874,375 | 4/1975 | Penner | 128/75 |
| 3,999,762 | 12/1976 | Castor | 272/144 |

FOREIGN PATENT DOCUMENTS

| | | | |
|---|---|---|---|
| 92663 | 4/1905 | Canada . | |
| 155458 | 5/1914 | Canada . | |
| 88238 | 12/1957 | Netherlands | 272/63 |
| 345114 | 4/1960 | Switzerland | 135/67 |

*Primary Examiner*—Richard C. Pinkham
*Assistant Examiner*—William R. Browne
*Attorney, Agent, or Firm*—Melvin Sher; Alan Swabey; Robert Mitchell

[57] ABSTRACT

This invention relates to an exercising apparatus which is adapted, in use, to provide relief from backaches and to maintain general physical fitness. The apparatus includes a pair of rests on which a person using the apparatus would support himself by his armpits. The rests are retained above a floor level in a spaced parallel arrangement, and they are either suspended from the ceiling by suspension members. The rests are constrained from movement in a longitudinal direction whereas means are provided for permitting the lateral movement of the rests. Disposed on each of the rests for carrying a part of the weight of a person using the apparatus are either hand grip or elbow support members. In use, a person using the apparatus mounts the apparatus in such a manner that his armpits are disposed over the rests. As the rests are movable in the lateral direction, the spacing between the rests can be adjusted to accommodate persons of different girth. The person then either grasps the hand grips or places his elbow and lower arm in the elbow support so that the weight of the person is supported both by the rests and the hand grips or elbow supports.

5 Claims, 11 Drawing Figures

Fig. 5
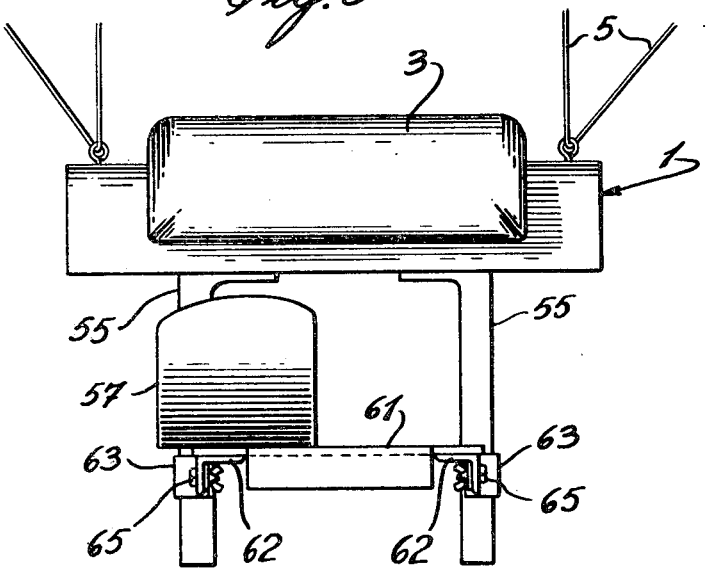
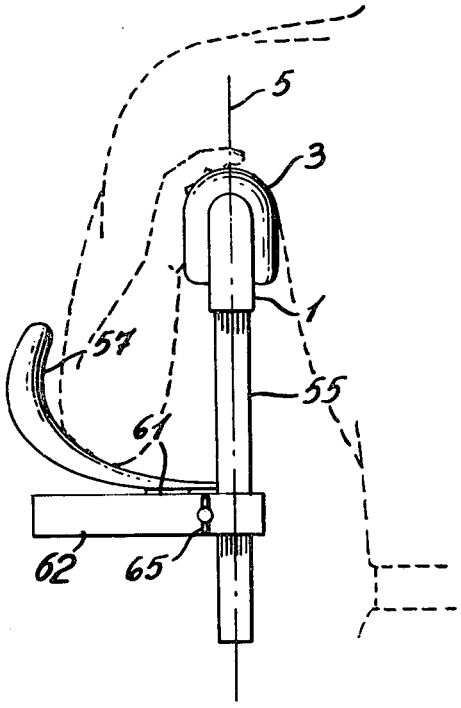
Fig. 7

EXERCISING PARALLEL BAR

CROSS-REFERENCE TO RELATED APPLICATIONS

This application is a Continuation-In-Part of U.S. application Ser. No. 687,090, filed May 17, 1976 now abandoned.

BACKGROUND OF THE INVENTION

1. Field of the Invention

This invention relates to an exercising apparatus which is adapted, in use, to provide relief from backaches and to maintain general physical fitness. More specifically, this invention relates to such an exercising apparatus which includes rests for suspending a person using the apparatus, the rests being constrained from motion in a foward and backward direction but being movable laterally to accommodate the girth of each individual such person.

2. Description of the Prior Art

It is well known in the art to provide exercising devices for suspending a person using the device. Thus, Netherlands Pat. No. 88,238, Spronck, issued June 4, 1958, Canadian Pat. No. 155,458, Boone, May 5, 1914, U.S. Pat. No. 2,788,971, Berne, Apr. 16, 1957 and U.S. Pat. No. 3,534,955, Wieland, Oct. 20, 1970, relate to parallel bar apparatus from which people can be suspended. However, as will be appreciated, the parallel bar apparatus are not normally used for the purpose of performing exercises which will relieve backaches. In addition, the structure of the parallel bar apparatus is quite dissimilar from the structure of the apparatus in accordance with the instant application in that the parallel bars, by the very nature of the exercises which are performed on the parallel bars, are not permitted any movement in a lateral direction.

Apparatus for back therapy are also known in the art as is shown, for example, in U.S. Pat. No. 3,046,980, Moore et al, July 31, 1962, U.S. Pat. No. 3,716,049, Kaplan, Feb. 13, 1973 and U.S. Pat. No. 3,874,375, Penner, Apr. 1, 1975. The Moore et al. patent, and the Kaplan patent do not teach exercise apparatus wherein a person is suspended. Although the Penner patent deals with an apparatus from which a person is suspended, the person, when using the Penner apparatus, is suspended by his legs. In contradistinction, a person using the apparatus in accordance with the instant invention is, generally speaking, suspended by his armpits. In addition, the structure of the Penner apparatus is quite distinct from the structure of the apparatus of the instant invention and bears only the similarity of a similar objective.

A Canadian patent to, Janisch, teaches an exercising apparatus in which a person is at least partially suspended from the armpits. However, in the Janisch apparatus, the suspension means are movable in a fore and aft direction, and in at least one embodiment, are constrained from movement in a lateral direction. Thus, the objectives of the exercising apparatus in accordance with the instant invention, and the physical structure thereof, are quite distinct from the exercising apparatus as taught in the Janisch patent.

SUMMARY OF THE INVENTION

It is therefore an object of the invention to provide an exercising apparatus which, in use will provide relief of backaches along with the maintenance of general physical fitness.

It is a further object of the invention to provide such an exercising apparatus which includes rests for suspending a person using the apparatus, the rests being constrained from movement in a fore and aft direction, but being movable in a lateral direction to adjust the spacing therebetween whereby to accommodate to the girth of different people.

It is a still further object of the invention to provide such an exercising apparatus wherein the rests are suspended from a surface above the exercising apparatus such as a ceiling.

It is a still further object of the invention to provide such an exercising apparatus wherein the rests are supported from a surface below the apparatus such as a floor.

It is a still further object of the invention to provide such an exercising apparatus which includes hand grip means disposed on the rests whereby to relieve any undue pressure under the armpits of the exercisor.

It is a still further object of the invention to provide elbow supports, disposed below the rests, whereby to relieve undue pressure under the armpits of a person using the apparatus.

In accordance with the invention, an exercising apparatus comprises: a pair of rests; means for retaining the rests above a floor level and for maintaining the rests in spaced, parallel arrangement, and for constraining the rests from longitudinal movement; means for permitting lateral movement of the rests; and further means, disposed on each of said rests, for carrying part of the weight of a person using the apparatus; the apparatus being adapted, in use, to be mounted by said person such that his armpits are disposed over the rests, whereby the weight of said person is carried partially by said rests and partially by said further means. hand The means for retaining may comprise, for each said rest, a pair of suspension members of, for example, wire or leg of said first legs and a lateral spacer means between said second legs. nylon cord, each member of said pair being attached at a respective end of its respective rests; and means for attaching said members to an upper surface.

Alternatively, the means for retaining may comprise, for each said rest, a pair of legs, each said leg extending downwardly from a respective end of its respective rest; a longitudinal spacer between each pair of legs; a first leg of each pair being associated with a first leg of the other pair and a second leg of each pair being associated with a second leg of the other pair; and a first lateral spacer means between said first second legs and a lateral spacer means between said second legs.

When the means for retaining comprise said leg means, the means for permitting lateral movement comprises a flexible portion in each said leg.

Said further means may comprise hand grips, and comprising for each said rest a pair of hand grip supporting members, each hand grip supporting member extending downwardly from a respective end of its respective rest; and means for adjustably retaining each hand grip on its respective pair of hand grip supporting members.

Alternatively, said further means may comprise elbow support means, and comprising, for each said rest: a pair of elbow support retaining members, each elbow support retaining member extending downwardly from a respective end of its respective rest; and means for adjustably retaining each elbow support means on its respective pair of elbow support retaining members.

In a different embodiment, the apparatus includes a pair of hand grip supporting members, each hand grip supporting member being fixed at one end of its respective rest, and extending upwardly from said respective rest; said hand grip extending inwardly from said hand grip supporting member at right angles thereto; and means for adjustably retaining each hand grip on its respective grip supporting member.

In a still further embodiment, said elbow support means comprises a canvas like material supported at one end thereof by a counterweight; and flexible collar means in the elbow supporting portion of said elbow support means.

BRIEF DESCRIPTION OF THE DRAWINGS

The invention will be better understood by an examination of the following description together with the accompanying drawings in which:

FIG. 5 is a side view of an enbodiment of the invention which is equipped with an elbow support;

FIG. 7 is an end view of one side of the embodiment illustrated in FIG. 5;

DETAILED DESCRIPTION OF THE DRAWINGS

Figure 1:
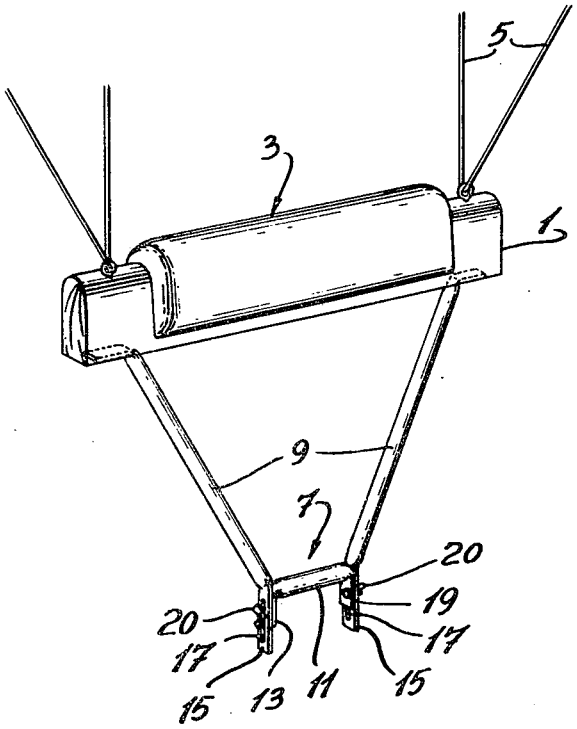
FIG. 1 is a side view of one embodiment of the invention wherein the rests are suspended from above.

In the drawings, like reference numerals represent like parts.

Figure 2:
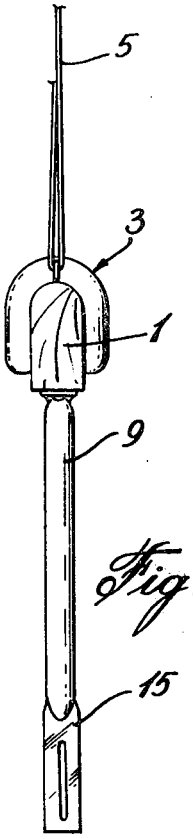
FIG. 2 is an end view of the embodiment illustrated in FIG. 1.

Referring now to FIGS. 1 and 2 of the drawings, the exercising apparatus consists of rests 1, which are preferably padded at the top thereof as at 3. Each rest is suspended from an upper surface, such as a ceiling, by suspension members 5. Preferably, the members 5 are of a flexible but sturdy material such as wire, nylon cord, or the like. For illustrative purposes, the disclosure will refer hereinafter to wire.

As can be seen in FIG. 2, the rests are horizontally spaced and maintained in parallel arrangement and at the same vertical height. The arrangemnt of the suspension wire will substantially prevent any movement in a fore and aft direction when the rests are supporting a person using the apparatus. On the other hand, because of the flexibility of the suspension wires, it is possible to move the rests in a lateral direction to adjust the spacing between the rests to accommodate the girth of different people.

The rests are also aligned with each other so that the forward end of the left hand rest is in alignment with the forward end of the right hand rest, and the aft end of the right hand rest is aligned with the aft end of the left hand rest.

Each side of the apparatus comprises a hand grip 7 which is supported on the underside of the rest by hand grip supporting members 9. The hand grip includes a body portion 11 and perpendicular flanges 13. The flanges 13 are aligned with vertical extensions 15 of the hand grip supporting members 9, and the hand grip is adjustably connected to the hand grip supporting members by means well known in the art. In accordance with one embodiment illustrated in FIGS. 1 and 2, the adjusting means comprises a slot 17 in the member 15, and an opening 19 in the flanges 13. A bolt and wing nut arrangement 20 extends through 19 and 17. To adjust the height of the hand grip, the nut is loosened, and the bolt slides in the slot to the desired level at which time the nut is again tightened.

This is, of course, only one adjustment means which could be used at this place, and other adjustment means well known in the art could also be employed for this purpose.

Figure 3:
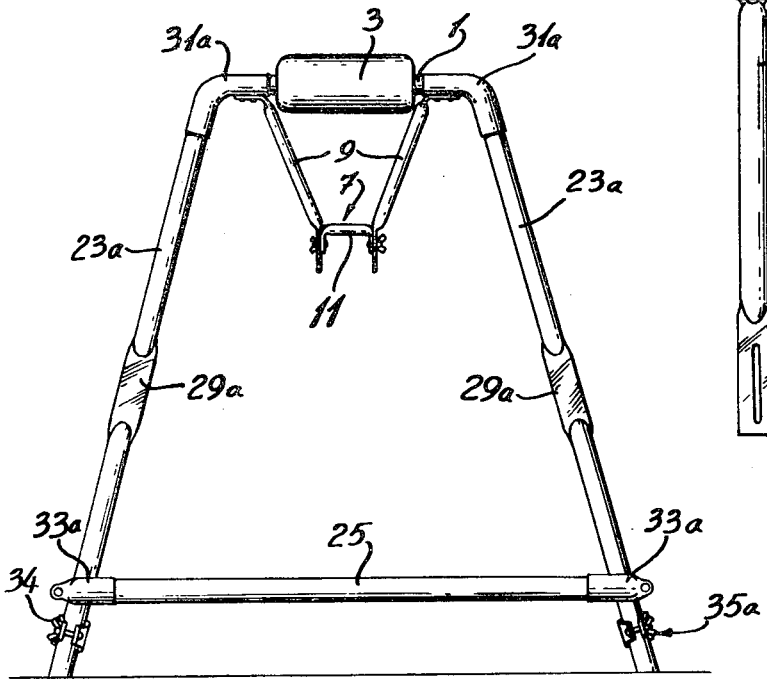
FIG. 3 is a side view of a second embodiment of the invention wherein the rests are supported from below.
Figure 4:
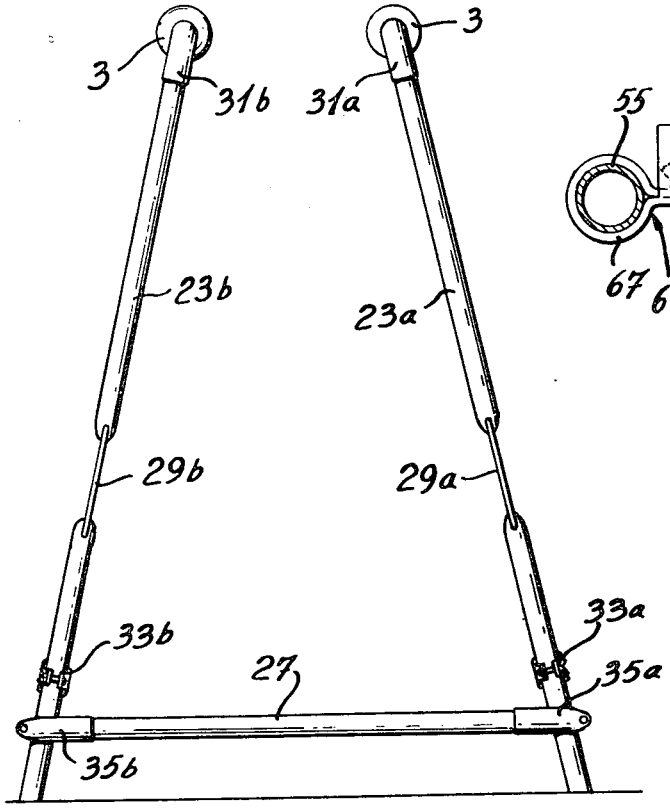
FIG. 4 is an end view of the embodiment illustrated in FIG. 3.
Figure 8:
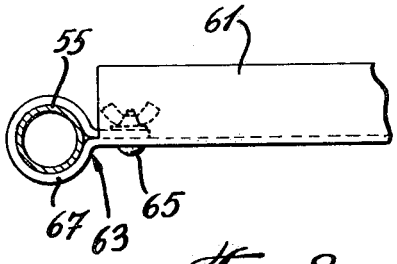
FIG. 8 is a plan view of the support means of FIG. 5.
Figure 6:
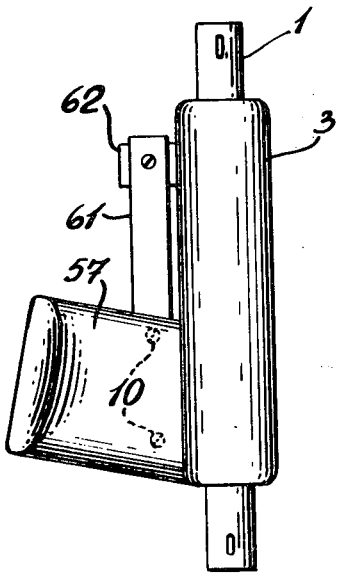
FIG. 6 is a plan view of FIG. 5.

Referring now to FIGS. 3 and 4, illustrated in these figures is an embodiment of the figures wherein the rest is supported from a lower surface such as a floor. In this embodiment, each rest 1 is connected, at each end thereof, to a pair of sloped vertical legs 23, and the legs of each pair are spaced apart by longitudinal spacer 25. The bottoms of the legs may be covered with, for example, rubber shoes, to prevent damage to the surface on which they are disposed. As can be seen in FIG. 4, each leg of a right hand pair of legs 23*a* is spaced from respective ones of a left hand pair of legs 23*b* by lateral spacers 27. Each of the legs includeas a flexible portion 29, and the flexible portion permits the lateral movement of the rest. However, the portions 29 are not flexible in the fore and aft directions so that the rest is constrained from movement in the fore and aft directions.

The embodiment illustrated in FIGS. 3 and 4 is adapted to be disassembled. To this end, the rest 1 is joined to the legs 23 by elbow sockets 31. The legs are tubular members, and the dimensions of the socket and the tubular members can be arranged to provide a force fit of the tubular members in the socket.

At the bottom end of the legs, the lateral spacers are extended in a thinned portion to provide wrap-around connectors 33. The free ends of 33 contain openings for receiving bolt and wing nut arrangements 34. With the use of the bolt and wing nut arrangement, it is a simple matter to assemble and disassemble the exercising apparatus by hand and without the use of special tools.

The hand grips 7 illustrated in FIGS. 1 to 4 are included for the purpose of providing for carrying part of the weight of a person using the apparatus as will be discussed below. However, the hand grips can be replaced by elbow supports as illustrated in FIGS. 5 to 8. Referring to these figures, a pair of elbow support retaining members 55 extend downwardly from each end of a respective rest 1. The elbow support consists of a member 57. Although not shown in the drawings, member 57 is preferably padded on the top. The elbow support is carried on angle iron 61 which is, in turn, carried on the horizontal portion of angle iron 62. 62 is slidingly carried on 55 by extension portions 63 of angle iron 62. To form the extension portions 63, the horizontal flanges of angle iron 62 are cut-off short of the respective members 55, and the vertical portions of 62, where they extend beyond 55, and wrapped around 55 in a sliding fit with the vertical member 55, to form cylindrical tubes 67, and then extend a distance beyond the point where the horizontal flanges have been cut, far enough to meet with the vertical portions and to allow for aligned openings in the adjacent portions which can accept bolt and wing nut clamps 65. The position of the elbow rest 57 is adjustable by sliding the wrap around portions 63 on their respective members 55. To retain the angle iron 61 at a horizontal position, bolt and wing nut arrangement 65 is tightened at that position, and when it is desired to move the elbow support up or down, the nuts are loosened and the angle iron is appropriately moved.

It will of course be appreciated that such an elbow support can replace the hand grip means in any and all of the embodiments illustrated in FIGS. 1 to 6 hereof.

In operation, the exercising apparatus works as follows:

A person using the apparatus positions himself between the two rests 1, places his arms over the rests, and adjusts the rests in a lateral direction until the rests are disposed under his armpits. As the rests will be disposed at a level higher than the level of the armpits of the person, the person will either have to pull himself up to put himself in position for using the apparatus, or he may stand on a stool while mounting the apparatus. If he stands on a stool, then the stool will be removed after the person has mounted the apparatus. In any case, when the rests are disposed under the armpits of the person, he will be suspended by the armpits. The exercise which has been recommended by medical authorities in association with the present apparatus consists of a forward and backward swinging movement of the lower body while supported by the armpits. This provides a combination of gravitational traction combined with manipulation, and has been shown to be effective in the relief of backaches. In this regard, it would appear that the exercise is most effective when the lower body is moved relative to the upper body, i.e., when the upper body is constrained from movement in the fore and aft direction. In order to accomplish this, it is of course necessary that the rests of the apparatus be substantially constrained from movement in the fore and aft direction, and applicant has provided an apparatus which is so constrained.

In view of the fact that the person using the apparatus is being supported under the armpits, there is a considerable amount of presure under the armpits, which pressure will, of course, vary with the weight of the person. If this pressure is sustained, there is a possibility that it could cause paralysis or partial paralysis of the hands because it would interfere with the brachial plexus.

To eliminate this possiblity, the hand grips or elbow rests are provided to relieve the pressure under the armpits. When using the hand grip embodiment, the person will grasp the hand grips which are adjusted to be at a distance from the top of the rest 1 somewhat less than the length of the person's arm from the bottom of the armpit to the hand. Thus, when the person grasps the hand grip and straightens his arm, his weight will be carried partially by the hand grip and partially by the rests. Insofar as the person is concerned, his weight will now be supported both under his armpits and by his arms.

In a like manner, in the elbow supports embodiment, when the person using the apparatus places his arms over the rests, he will lay his elbow and the lower part of his arm in the elbow support. Again, the height of the elbow support is adjusted so that the weight of the person will be supported both by the rests and the elbow support.

Figure 9:
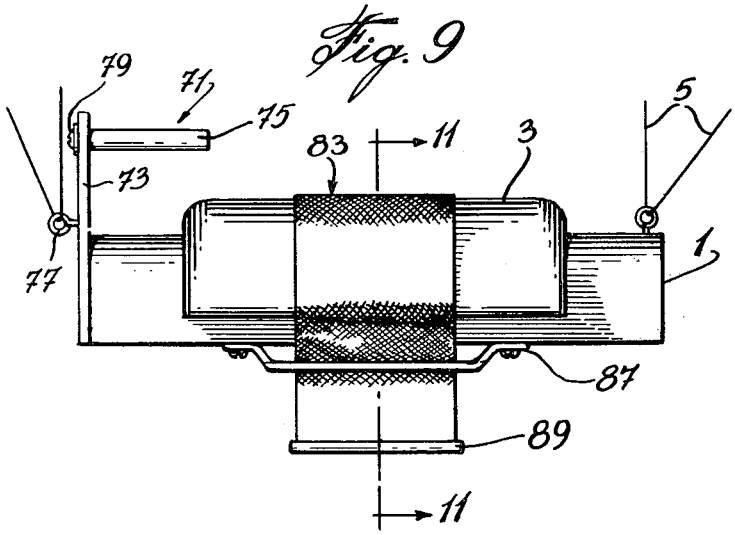
FIG. 9 is a side view of a further embodiment of the invention.
Figure 10:
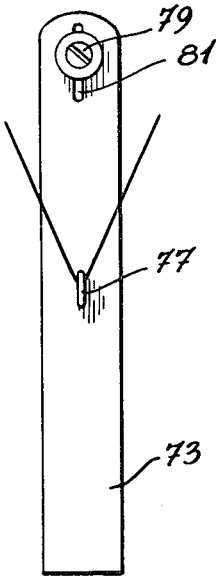
FIG. 10 illustrates details of the above rest hand grip illustrated in FIG. 9.
Figure 11:
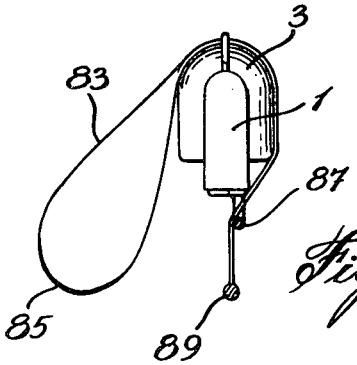
FIG. 11 is a section through 11—11 of FIG. 9.

The above principles are also embodied in a further embodiment as illustrated in FIGS. 9, 10 and 11. In this further embodiment, the hand grip member is placed above rather than underneath the rest, and the elbow support means comprises a canvas like material.

Referring to FIG. 9, the hand grip arrangement 71 comprises a vertically upright hand grip supporting member 73, which is disposed at one end of the arm rest and which extends upwardly therefrom. extending inwardly from the vertical member 73 is the hand grip 75 which extends inwardly from the hand grip supporting member 73 and at right angles thereto. To permit adjustment of the height of the hand grip 75, screw 79 extends through slot 81 of the member 73. To adjust the height, the screw 79 is loosened and the hand grip 75 is moved vertically up or down. When the correct position is obtained, the screw 79 is again tightened so that the hand grip is retained in its new vertical position.

The elbow support 83 comprises a canvas like material. In the elbow supporting portion of the elbow support means, a flexible collar 85 is included. The elbow support means is supported by a bracket 87 disposed under the arm rest 1, and a counterweight 11 is disposed at one end of the canvas like material to act against the downward force of the elbow in the arrangement.

To form the elbow support means, a length of canvas is folded and one end is formed to accommodate the user's arm as shown in the drawings. The other ends are fastened together and the weight is disposed at one end of the fastened together portion. The canvas is then placed across the padding and, as shown in FIG. 11, brought down and threaded through the space between the bottom of the rest and the bracket 87.

With the pressure of the user's armpit and his side holding the canvas tight against the padding, simple friction will prevent any slipping movement.

Although in FIGS. 9, 10 and 11 both the hand grip and the elbow support are shown on a single rest, it will of course be appreciated that each arm rest can contain only a hand grip or only an elbow support means or both.

In operation, the embodiments of FIGS. 9, 10 and 11 are used in the same way as described relative to the embodiments in FIGS. 1 to 8.

Although several embodiments have been described above, this was for the purpose of illustrating, but not limiting, the invention. Various modifications which will come readily to the mind of one skilled in the art are within the scope of the invention as defined in the appended claims.

I claim:

1. An exercising apparatus comprising:

a pair of rests;

means for retaining the rests above a floor level and for maintaining the rests in spaced, parallel arrangement, and for constraining the rests from longitudinal movement;

said means permitting only unrestrained lateral movement of the rests; and further means, disposed on each rest of said pair of rests, for carrying part of the weight of a person using the apparatus,;

the apparatus being adapted, in use, to be mounted by said person such that his armpits are disposed over the rests, whereby the weight of said person is carried partially by said rests and partially by said further means;

characterized in that said means for retaining comprises, for each rest, a pair of cables, each cable of said pair being attached at one end to a supporting surface above the apparatus and at the other end to a respective end of its respective rest.

2. An apparatus as defined in claim 1 wherein said further means comprises hand grips, and comprising for each said rest:

a pair of hand grip supporting members, each hand grip supporting member extending downwardly from a respective end of its respective rest; and means for adjustably retaining each hand grip on its respective pair of hand grip supporting member.

3. An apparatus as defined in claim 1 wherein said further means comprises elbow support means, and comprising, for each said rest:

a pair of elbow support retaining members, each elbow support retaining member extending downwardly from a respective end of its respective rest; and means for adjustably retaining an elbow support rest on said pair of elbow support retaining members.

4. An apparatus as defined in claim 1 wherein each said further means comprises hand grips, and comprising for each said rest:

nand grip supporting members, each hand grip supporting member being fixed at one end of its respective rest and extending upwardly from said respective rest;

each hand grip extending inwardly from said hand grip supporting member at right angles thereto; and means for adjustably retaining each hand grip on its respective hand grip supporting member.

5. An apparatus as defined in claim 1 wherein each said further means comprises elbow support means;

said elbow support means comprising a canvas like material supported at one end thereof by a counterweight; and said elbow support means having a flexible collar means which supports an elbow.

* * * * *